United States Patent [19]

Chapman, Jr.

[11] 4,365,427

[45] Dec. 28, 1982

[54] SUCTION DREDGE CUTTER HEAD

[76] Inventor: Marion R. Chapman, Jr., 1102 D. Holik Dr., College Station, Tex. 77840

[21] Appl. No.: 285,527

[22] Filed: Jul. 21, 1981

[51] Int. Cl.[3] ..... E02F 3/92

[52] U.S. Cl. ..... 37/57; 37/67; 241/84

[58] Field of Search ..... 37/64, 65, 67, 57; 241/46.11, 84, 83, 95, 46.06, 46 R

[56] References Cited

U.S. PATENT DOCUMENTS

| | | | |
|---|---|---|---|
| 386,866 | 7/1888 | Brainard | 37/65 |
| 1,087,269 | 2/1914 | Baltz | 37/67 |
| 2,530,951 | 11/1950 | Enright | 37/57 X |
| 3,909,960 | 10/1975 | Casciano | 37/65 X |
| 4,296,970 | 10/1981 | Hodges | 37/65 X |

FOREIGN PATENT DOCUMENTS

| | | | |
|---|---|---|---|
| 1120538 | 7/1968 | United Kingdom | 37/67 |
| 601418 | 4/1978 | U.S.S.R. | 37/67 |
| 612031 | 6/1978 | U.S.S.R. | 37/67 |
| 628242 | 10/1978 | U.S.S.R. | 37/65 |

*Primary Examiner*—Clifford D. Crowder
*Attorney, Agent, or Firm*—Cushman, Darby & Cushman

[57] ABSTRACT

The cutter head of a suction dredge has a crusher rotatably mounted within, cooperating with, and driven by a gear train from the head to crush and reduce the size of hard lumps dug by the head to reduce damage to and clogging of the suction and discharge lines and the dredge pump.

6 Claims, 5 Drawing Figures

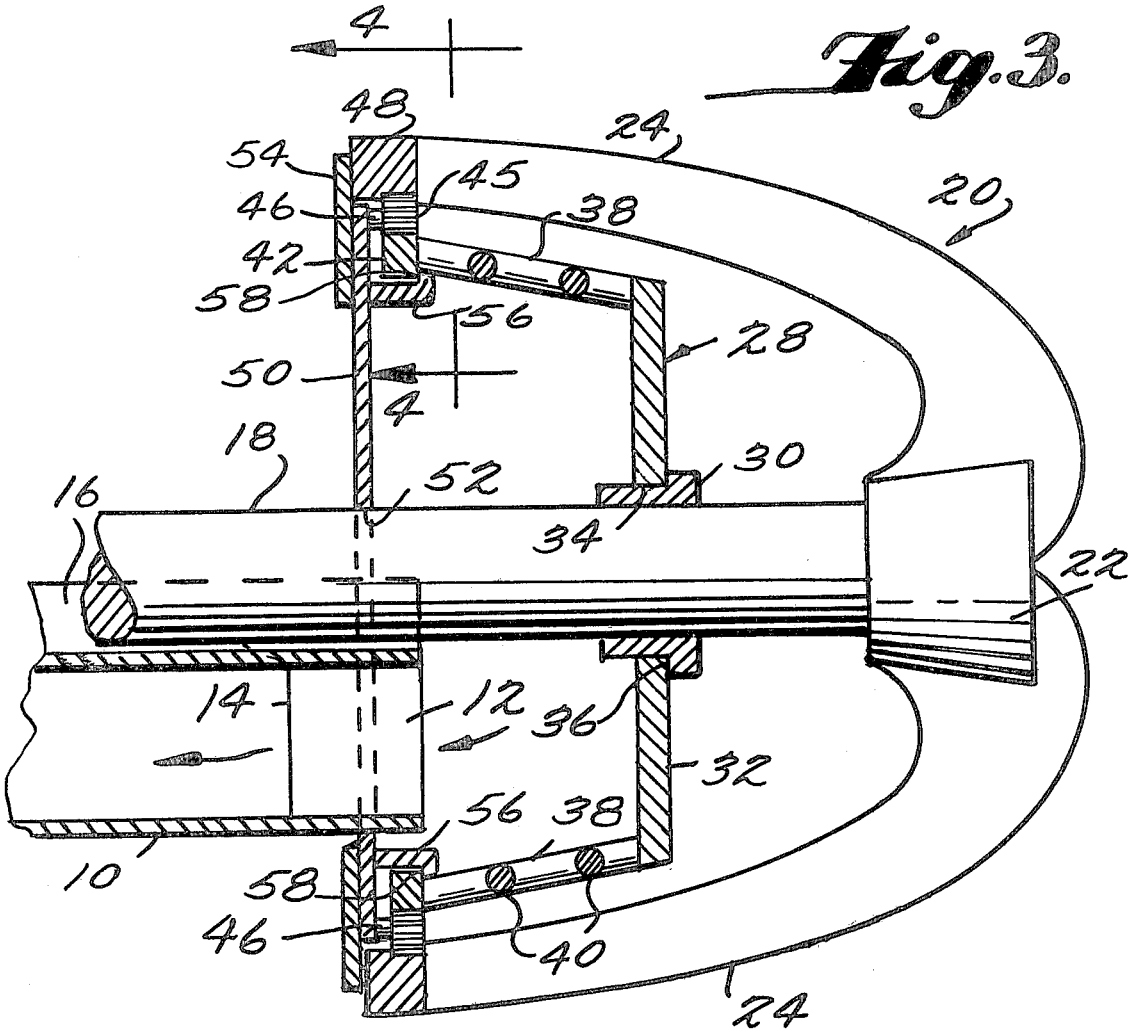
Fig. 3.
Fig. 4.
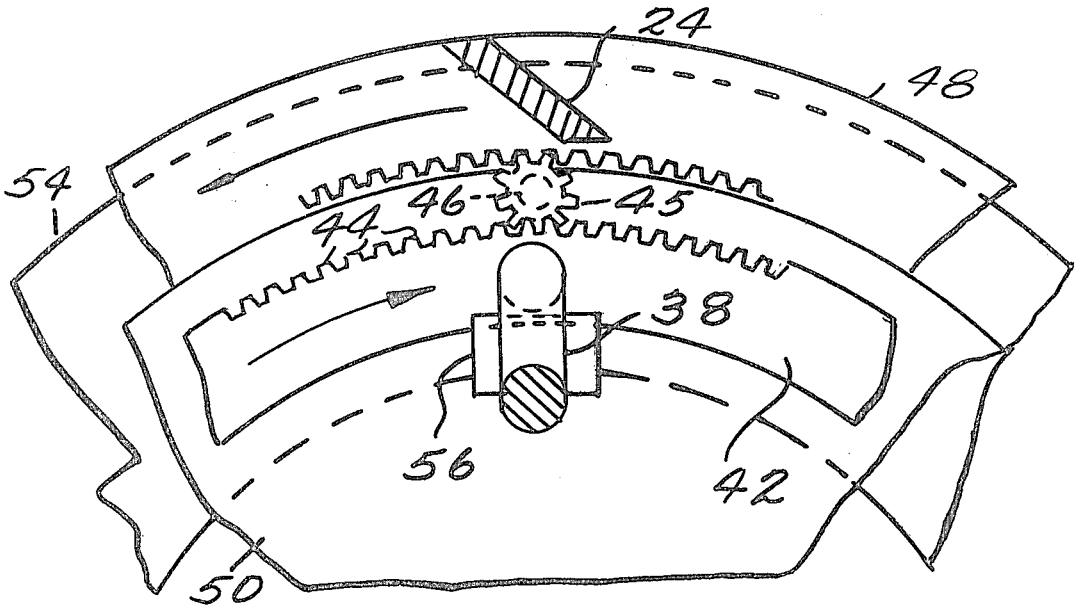

SUCTION DREDGE CUTTER HEAD

FIELD OF THE INVENTION

This invention relates to dredges and, more particularly, to improvements in the cutter heads of suction dredges for crushing solids to minimize clogging of and damage to suction and discharge pipes and dredge pumps.

BACKGROUND OF THE INVENTION

Suction dredges normally have a downwardly and forwardly inclined ladder carrying a suction pipe which has a suction mouth at its lower end and a rotatable cutter head just forward of such mouth. The head normally is driven by a shaft extending along the ladder from a motor on the upper end of the ladder. Usually the cutter head has a plurality of angularly spaced, toothed ribs spiralling rearwardly from the forward end of the drive shaft. When sand or muck is being dredged, no problems normally arise. When the cutter head is working in hard lumpy clay, sandstone, coral, or other fossil or rock formations, however, problems are encountered in the production of large hard lumps that pass through the cutter head and are large enough to clog or damage the suction and discharge lines and the dredge pump. Clogging or stopping of the lines necessitates time consuming down-time clean-out operations. Pump damage necessitates expensive down-time replacement or repair.

BRIEF SUMMARY OF THE INVENTION

Accordingly, it is an object of this invention to incorporate in the cutting head of a suction dredge simple, inexpensive and efficient means for crushing large hard lumps of material dug by the head before they enter the suction pipe to minimize or prevent clogging of and/or damage to the suction and discharge lines and the dredge pump.

It is another object of this invention to provide such crushing means in the form of a crusher that can be easily installed within a conventional cutter head, and driven thereby, with few modifications to the head and ladder.

The foregoing objects are accomplished by an open-work crusher journalled on the cutter head drive shaft and driven by a plurality of pinion gears supported by the suction pipe and meshing with opposed ring gears on the rear ends of the cutter head and the crusher.

Other objects and advantages of the invention will become apparent from the following detailed description and accompanying drawings, in which:

BRIEF DESCRIPTION OF THE DRAWINGS

FIG. 3 is a longitudinal sectional view of the cutter head shown in FIG. 1, but showing a modification thereof;

FIG. 4 is an enlarged fragmentary view taken substantially on line 4—4 of FIG. 3.

DETAILED DESCRIPTION OF THE INVENTION

Figure 5:
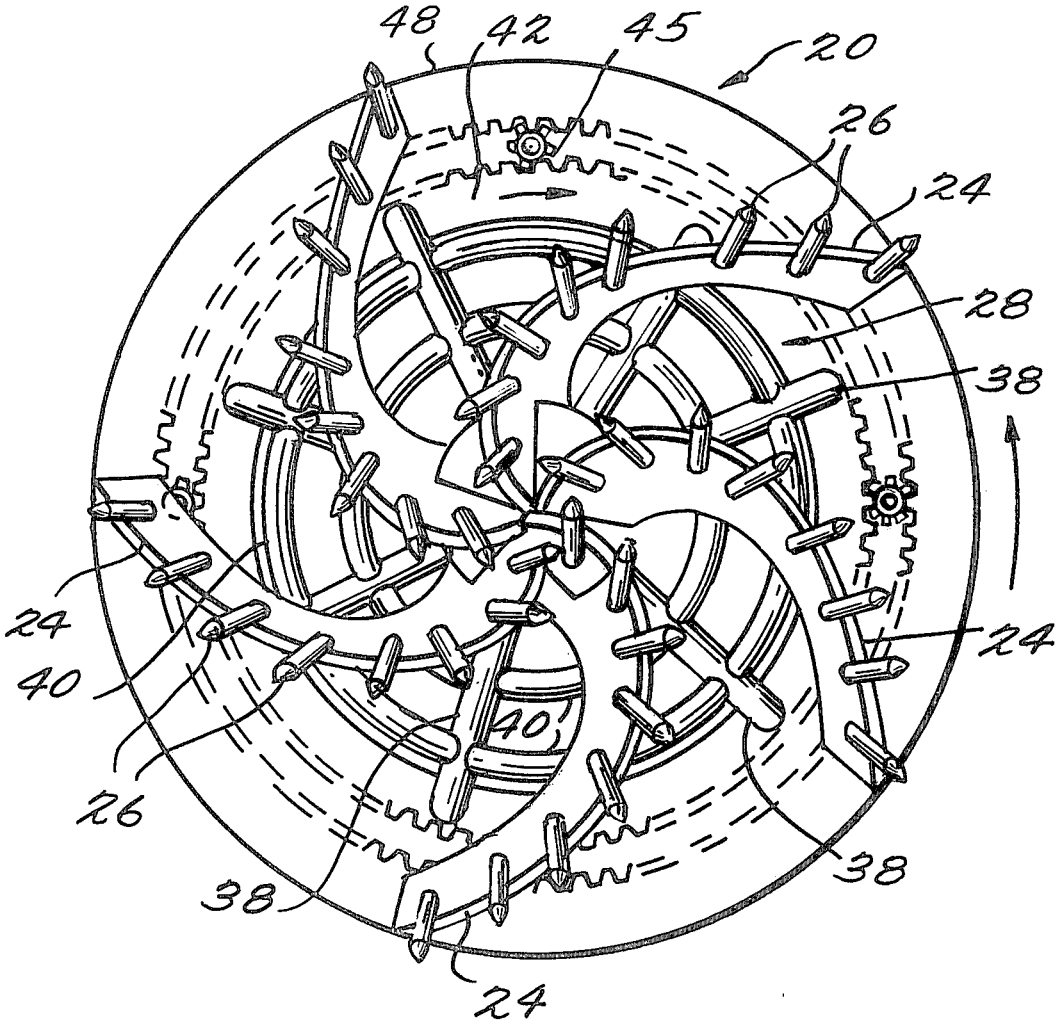
FIG. 5 is an end view of the cutter head shown in FIG. 1.

Referring now to the drawings, there is shown the lower end of the usual suction pipe 10 carried by the ladder (not shown) of a suction dredge. The pipe 10, which is normally semi-circular in cross-section, terminates in a suction mouth 12 having a central reenforcing partition plate 14, and is channelled, as at 16, along the upper planar side thereof for accommodation of a drive shaft 18 for a cutter head 20. The lower end of the shaft 18 is journalled in a bearing (not shown) supported on the ladder and projects beyond the suction mouth 12. Secured on the end of shaft 18 is the hub 22 of the cutter head 20 from which spiral rearwardly a plurality of angularly spaced ribs or arms 24 equipped with projecting teeth 26. The head 20 normally is driven in the direction shown by the arrow in FIG. 5. The ribs 24 are shown only schematically in FIGS. 1 and 3 with no spiral configuration and with the teeth being omitted for simplification. In operation, the ladder is lowered to urge the head 20 against the marine bottom, the shaft 18 is driven by a motor (not shown) on the upper end of the ladder or on the dredge hull and the dredge pump (not shown) is driven by a prime mover (not shown) on the dredge hull to suck water and solids, i.e., cutter debris, through the mouth 12 of the suction pipe 10 for conveyance through a discharge line (not shown) to any desired location.

When the cutter head 10 is operating in sand or muck, the solids or cutter debris are no problem. On the other hand, when the cutter head 10 is operating in hard lumpy clay, sandtone, coral or other fossil or rock formations, large hard lumps are produced which pass between the arms or ribs 24 of the cutter head and into the mouth 12 of the suction pipe 10. Such hard lumps are apt not only to clog the suction pipe 10 but also to clog or damage the dredge pump. Moreover, such lumps may damage the suction line 10 and also damage or clog the discharge line (not shown) if they pass undiminished in size through the dredge pump. In any event, the passage of such hard lumps into the suction pipe 10 is not to be desired, and this invention provides means for crushing such hard lumps into smaller non-damaging and non-clogging pieces before passage into the suction pipe.

For this purpose, there is provided within the cutter head 20 a crusher 28 of open-work frusto-conical construction journalled, at its forward end on the drive shaft 18. Preferably this is accomplished by a sleeve bearing 30 secured to the shaft 18 by any appropriate means, e.g., welding. The forward end of the crusher 28 may be of planar circular plate-like construction, as at 32, having a central aperture 34 receiving the sleeve bearing 30 and resting against a rearwardly facing shoulder 36 on such bearing. Extending rearwardly from the periphery of the plate 32 is a crusher grid of interconnected longitudinal and circumferential bars 38 and 40, respectively, having openings therebetween. The openings are sized to pass lumps or chunks of hard material of only a predetermined maximum size, for example, it has been found that lumps of 4" maximum cross-sectional dimension will pass readily through the pump and lines of a 14" dredge, i.e., having 14" lines and pumps. Hence, for a 14" dredge, the openings should be no larger than 4" maximum dimension.

Figure 2:
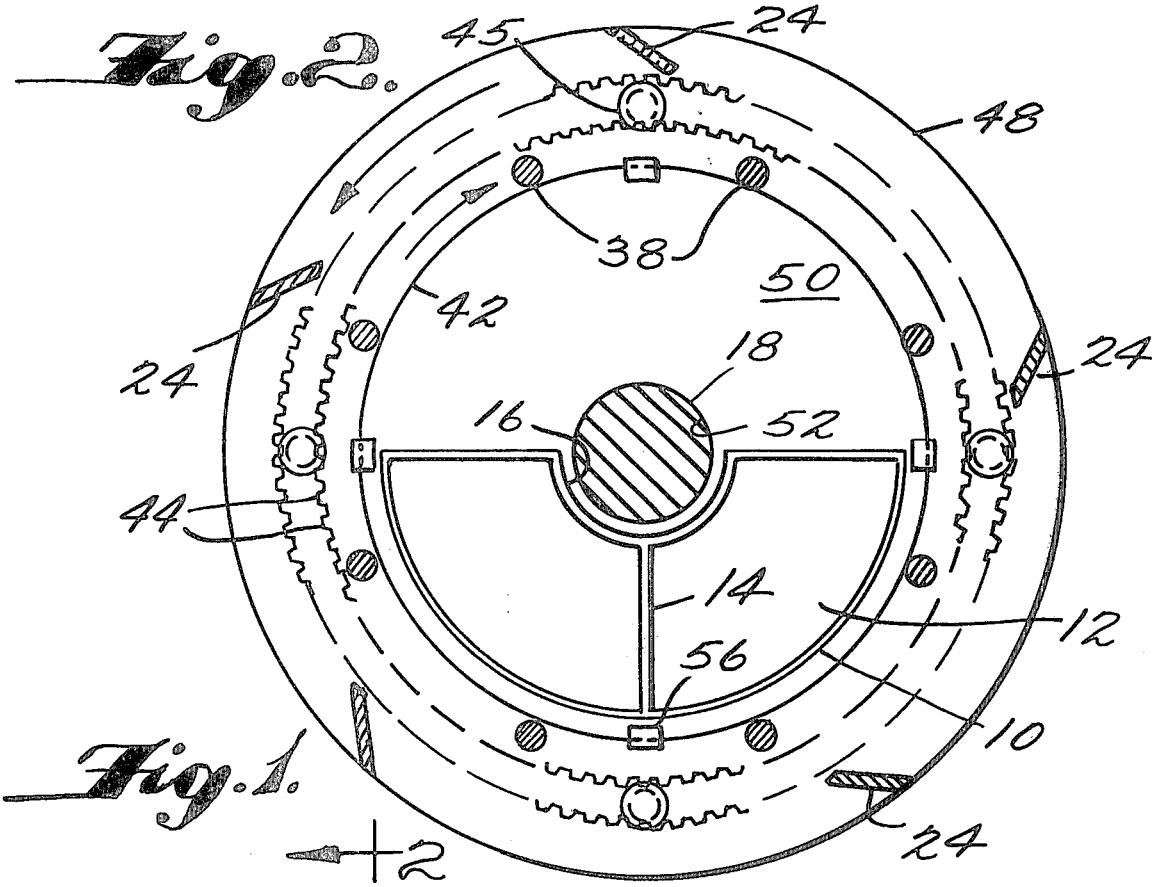
FIG. 2 is a sectional view taken substantially on line 2—2 of FIG. 1.
Figure 1:
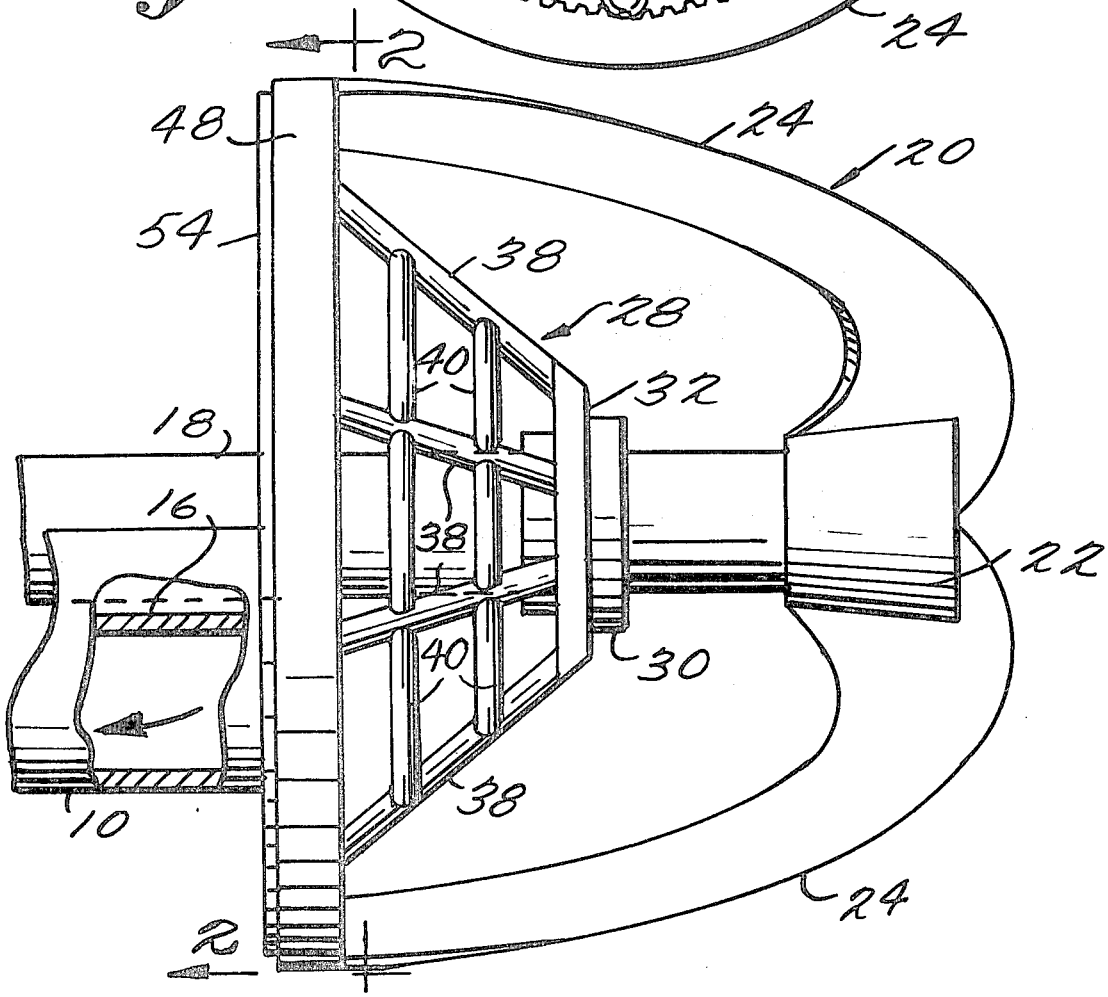
FIG. 1 is a side elevation, partially in section and partially schematic with parts ommitted, of a suction dredge cutter head embodying this invention.

At its rear end, the grid is secured to a ring gear 42 of larger diameter than the plate 32 and having outwardly facing teeth 44. In this connection, it should be noted that the diameter of the plate 32 can be varied to vary the inclination of the longitudinal bars 38 to change the crushing effectiveness of the crusher 28. For example, FIG. 1 shows a crusher having a greater angle of inclination of its longitudinal bars 38 than the crusher 28 shown in FIG. 3. In any event, the crusher 28 is driven, as later described, to rotate counter to the cutter head 20 so that the bars 38 cooperate with the cutter head arms 24 to produce a crushing action on lumps between the grid and the arms 24. The ring gear 42, and hence the crusher 28, is driven counter to the direction of rotation of the cutter head 20 by a circular array of pinion gears 45 rotatable on fixed stub shafts 46 and meshing with the inner teeth of and driven by a ring gear 48 mounted to the rear ends of the cutter head ribs 24. Thus the crusher 28 is driven by the shaft 18 in a direction opposite to that of the cutter head 20. The stub shafts 46 are secured, as by welding, to a plate 50 secured, as by welding, to the outer end of the suction pipe 10 with the shaft 18 extending through an opening 52 in the plate. An annular guide plate 54 is secured, as by welding to the rear surface of the outer marginal edge portion of the plate 50 and projects therebeyond into guiding relation with the rear surface of the ring gear 48 on the cutter head 20. A circular array of guide brackets 56 secured, as by welding, to the plate 50, project forwardly thereof in guiding relation with the inner circumferential surface of the ring gear 42 on the crusher 28. Preferably, the brackets 56 are provided with rearwardly facing guide shoulder 58 engaged over the forward inner marginal surface portion of the crusher ring gear 42 to assist the shoulder 36 on the bearing 30 in maintaining the crusher ring gear 42 in operative meshing engagement with the pinion gears 44. Since all the moving parts of the assembly are submerged in operation, they are lubricated by water.

The construction of the crusher 28 is such that it, and its bearing and driving components, can be installed in a conventional cutter head with only minor modifications to the head, the suction pipe and the ladder. In actual practice, it has been found that the power normally required to drive the conventional cutter head 20 is sufficient to additionally drive the crusher 28. It also has been found that the combination of the crusher 28 with the cutter head 20 greatly reduces vibration on the dredge and in the dredge pumping system, apparently by minimizing or eliminating the passage therethrough of large lumps of hard material. It further has been found that the crusher 28 increases the percentage of pumpable solids, thus increasing production. Even further, the crusher 28 reduces down time for cleaning clogged lines and repairing the dredge pump with resultingly increased operating time and efficiency.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

What is claimed is:

1. For use with a suction dredge having a suction pipe, the combination comprising:

a driven cutter head of open-work construction which encloses and is rotatable adjacent the mouth of the pipe about an axis generally parallel to the axis of the pipe, said head comprising a plurality of digging arms which spiral divergently rearward from hub means forward of the mouth and recede rearward of the direction of their rotation; and crusher means of grid-like open-work construction within said head and cooperating with said arms to crush, on relative rotation between said head and crusher means, large objects dug by and passing through said head in order to minimize damage and clogging of suction and discharge lines and the dredge pump of the dredge, said crusher means being of generally frusto-conical configuration and generally-coaxial with said head, and provided with interconnecting generally circumferential and generally longitudinal bars, whereby said arms sweep large objects into the clearance between said arms and bars so as to exert a crushing action which breaks the objects into smaller pieces which can pass through the openings in said crusher means and into the mouth of the pipe.

2. The structure defined in claim 1 wherein the crusher means is rotatable about the axis of the cutter head.

3. The structure defined in claim 1 including a gear train for driving the crusher means by the head.

4. The structure defined in claim 3 wherein the gear train drives the crusher means in a direction opposite to that in which the head is driven.

5. The structure defined in claim 1 wherein the cutter head is driven by a shaft extending beyond the mouth of the suction pipe, the forward end of the crusher means is journalled on the shaft and including:

opposed ring gears on the rear portions of the cutter head and the crusher means;

plate means secured to the pipe adjacent its mouth; and pinion gears supported on said plate means meshing with said ring gears for driving the crusher means by rotation of the head.

6. The structure defined in claim 1 wherein the maximum dimension of the openings in the cutter means is less than the maximum dimension of the openings in the cutter head.

* * * * *